US008498432B2

(12) United States Patent
Suyama

(10) Patent No.: US 8,498,432 B2
(45) Date of Patent: Jul. 30, 2013

(54) DIGITAL MIXER AND METHOD OF CONTROLLING THE SAME

(75) Inventor: Akio Suyama, Hamamatsu (JP)

(73) Assignee: Yamaha Corporation (JP)

( * ) Notice: Subject to any disclaimer, the term of this patent is extended or adjusted under 35 U.S.C. 154(b) by 196 days.

(21) Appl. No.: 12/837,760

(22) Filed: Jul. 16, 2010

(65) Prior Publication Data

US 2011/0064248 A1 Mar. 17, 2011

(30) Foreign Application Priority Data

Jul. 17, 2009 (JP) ..... 2009-169204

(51) Int. Cl.
*H04B 1/00* (2006.01)

(52) U.S. Cl.
USPC ..... 381/119; 369/4; 715/716; 700/94

(58) Field of Classification Search
USPC ..... 381/119, 11, 81, 77, 56, 109, 107, 381/104, 12, 22, 23; 369/4, 1; 700/94; 715/716
See application file for complete search history.

(56) References Cited

U.S. PATENT DOCUMENTS 6,795,560 B2 * 9/2004 Hamamatsu ..... 381/119
7,139,625 B2 * 11/2006 Aiso et al. ..... 700/94
7,698,009 B2 * 4/2010 Cotey et al. ..... 700/94

FOREIGN PATENT DOCUMENTS

EP 1 551 119 A2 7/2005
JP 2007-053631 A 3/2007

OTHER PUBLICATIONS

Yamaha Corporation, "LS9 Digital Mixing Console Owner's Manual", 2006.*
CS1D CONTROL SURFACE Owner's Manual, YAMAHA Corporation, 2002 (especially Operating Manual (Basic Operation) pp. 39-43, 65-67 and Reference Manual (Software) p. 186, 187).
"PM5D DIGITAL MIXING CONSOLE Owner's Manual," YAMAHA Corporation, 2004 (especially pp. 40-45, 245, 268-273, 283).
Extended European Search Report for corresponding EP 10169613.6, mail date Aug. 29, 2012.

* cited by examiner

*Primary Examiner* — Vivian Chin
*Assistant Examiner* — Con P Tran
(74) *Attorney, Agent, or Firm* — Rossi, Kimms & McDowell LLP

(57) ABSTRACT

A digital mixer is configured to store, in response to a store operation by a user, values of parameters for one input channel stored in a current memory together with the bus type of each mixing bus at the time of the store into a library as one preset, and to recall, when recalling the values of the parameters in the stored one preset into the current memory in response to a recall operation by the user, the values of the parameters in the preset after converted into parameters corresponding to the bus type at the time of the recall regarding a part of the buses whose bus type stored does not coincide with the bus type at the time of the recall.

12 Claims, 10 Drawing Sheets

DIGITAL MIXER AND METHOD OF CONTROLLING THE SAME

BACKGROUND OF THE INVENTION

1. Field of the Invention

The present invention relates to a digital mixer which includes mixing buses each mixing audio signals supplied from a plurality of input channels and in which monaural and stereo types can be selected for pairs of the mixing buses.

2. Description of the Related Art

Digital mixers, for example, described in Documents 1 to 3 have been conventionally known as a digital mixer which includes mixing buses each mixing audio signals supplied from a plurality of input channels and in which monaural and stereo types can be selected for pairs of the mixing buses.

In these digital mixers, a user can select, for each pair of two mixing buses, whether to make these mixing buses function as independent monaural buses or function as stereo buses as a pair. This selection can be performed in an alternative manner on a screen shown in FIG. 3 in the digital mixer described in Document 3 and performed in the form of set/defeat of pairing of the buses in the digital mixers described in Documents 1 and 2.

Besides the above setting, the digital mixers described in Documents 1 and 2 have, in addition to a scene memory that stores a plurality of sets of all parameters used for mixing processing, a channel library function that stores in advance, as presets, a plurality of sets of values of parameters for signal processing in one input channel and recalls the values of the parameters of an arbitrary preset as the values of parameters for an arbitrary input channel.

Document 1: "CS1D CONTROL SURFACE Owner's Manual," YAMAHA Corporation, 2002 (especially Operating Manual (Basic Operation) pp. 39-43, 65-67 and Reference Manual (Software) p. 186, 187)

Document 2: "PM5D DIGITAL MIXING CONSOLE Owner's Manual," YAMAHA Corporation, 2004 (especially pp. 40-45, 245, 268-273, 283)

Document 3: Japanese Patent Laid-open Publication No. 2007-53631

SUMMARY OF THE INVENTION

When enabling the type of the mixing buses, the kinds of parameters for the signal processing on the route of transmitting signals from the input channel to the buses are different depending on whether the type is monaural or stereo.

For example, when operating the two mixing buses as independent monaural buses, parameters of two send levels and two send ONs which correspond to the two respective buses are included in the preset, whereas when operating the two mixing buses as the stereo buses in a pair, parameters of one send level, one send ON and one pan which are common to the two buses are included in the preset.

Accordingly, there has been a problem that when the type of the buses at the time of recalling a preset is different from the type at the time of storing the preset, parameters required for executing the signal processing according to the type at the time of the recall cannot be obtained from the recalled preset, by merely recalling the preset.

To approach such a problem, for example, in the digital mixer described in Document 1, it is prohibited to recall the values of the parameters of the preset regarding the buses for which the type of monaural/stereo (pair) at the time of recalling the preset is different from the type at the time of storing the preset (reflected to the format of the preset).

In such an approach, however, there is another problem that even when the preset is recalled, the contents of the preset cannot be reflected at all regarding the buses whose type at the time of the recall is different from that at the time of store.

An object of the invention is to solve the above problem and to enable, in a digital mixer in which monaural and stereo types can be selected for a pair of the mixing buses and in the case where parameters for one input channel can be stored and recalled, to appropriately recall the values of parameters relating to signal transmission from the input channel to the mixing buses even when the type of the buses at the time of recalling the parameters is different from the type of the buses at the time of storing the parameters.

To attain the above objects, a digital mixer of the application includes: two mixing buses that respectively mix audio signals supplied from a plurality of input channels; a designating device that designates either of monaural and stereo as a bus type of the two mixing buses; a current memory that stores values of parameters corresponding to the bus type designated by the designating device, for each of the plurality of input channels; an editor that edits the value of the parameter stored in the current memory in response to an edit operation by a user; a plurality of level controllers, each of which is in each input channel of the plurality of input channels, and controls level of an audio signal inputted to the input channel based on the bus type designated by the designating device and the values of the parameters stored in the current memory for the input channel, and the audio signal after the control being supplied from the input channel to the two mixing buses; a library that stores a plurality of presets; a storing device that stores, in response to a store operation regarding one input channel and one preset by the user, the values of the parameters stored in the current memory for the one input channel and the bus type currently designated by the designating device, as the one preset into the library; and a recalling device that, in response to a recall operation regarding one input channel and one preset by the user, reads values of the parameters and the bus type of the one preset stored in the library, and a) if the bus type in the one preset coincides with the bus type designated by the designating device, writes the values of the parameters of the one preset into the current memory as the values of the parameters for the one input channel, and b) if the bus type of the one preset does not coincide with the bus type designated by the designating device, converts the values of the parameters of the one preset into values of the parameters corresponding to the bus type designated by the designating device and writes into the current memory as the values of the parameters for the one input channel.

In the digital mixer of the invention, it is preferable that the current memory stores, for each of the plurality of input channels, a) values of two level parameters corresponding to each of the two mixing buses, if the designating device designates monaural as the bus type, and b) values of one level parameter and one pan parameter corresponding to a pair of the two mixing buses, if the designating device designates stereo as the bus type.

Further, it is also preferable that, if the bus type in the one preset to be recalled is stereo and the bus type designated by the designating device is monaural, the recalling device converts the values of the one level parameter and the one pan parameter of the one preset read out from the library into the two level parameters corresponding to each of the two mixing buses, such that an adjustment value for L and an adjustment value for R are obtained based on the value of the one pan parameter of the one preset, and then are respectively added to the one level parameter of the one preset or respectively multiply the one level parameter of the one preset to obtain the two level parameters.

Alternatively, it is also preferable that, if the bus type in the one preset to be recalled is monaural and the bus type designated by the designating device is stereo, the recalling device converts the values of the two level parameters of the one preset read out from the library into the values of the one level parameter and the one pan parameter corresponding to the pair of the buses such that the value of the one pan parameter is obtained based on a difference or a ratio between the values of the two level parameters, and the value of the one level parameter is obtained based on the value of one of the two level parameters and the obtained value of the pan parameter.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, embodiments to embody the invention will be concretely described based on the drawings.

Figure 1:
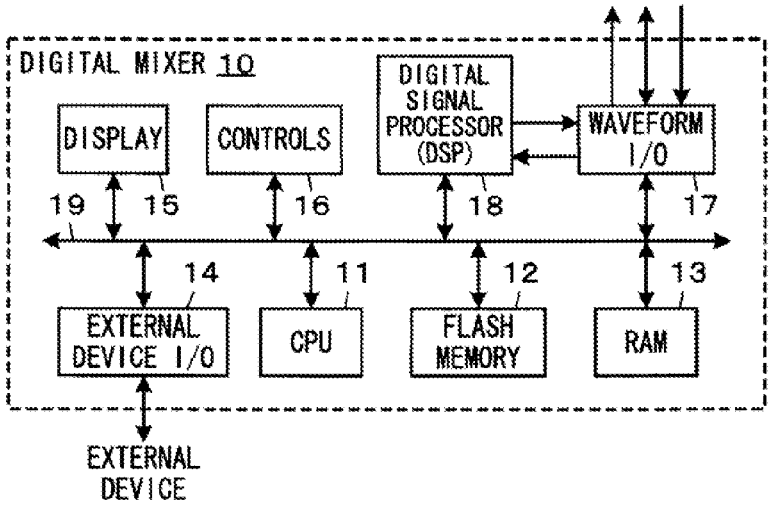
FIG. 1 is a diagram showing the hardware configuration of a digital mixer being an embodiment of the invention.

Configuration of a digital mixer being an embodiment of the invention will be described first. FIG. 1 is a block diagram showing the configuration of the digital mixer.

As shown in FIG. 1, the digital mixer 10 includes a CPU 11, a flash memory 12, a RAM 13, an external device input/output module (I/O) 14, a display 15, controls 16, a waveform I/O 17, a digital signal processor (DSP) 18, which are connected by a system bus 19. The digital mixer has a function of performing various kinds of signal processing on audio signals inputted through a plurality of input channels and outputting the processed audio signals through a plurality of output channels.

The CPU 11, which is a controller that comprehensively controls the operation of the digital mixer 10, executes a predetermined program stored in the flash memory 12, thereby performing processing such as controlling input/output of data and signals at the external device I/O 14 and the waveform I/O 17 and display on the display 15 and detecting the operation at the controls 16 to set/change values of parameters and control the operations of modules in response to the detected operation.

The flash memory 12 is a rewritable non-volatile memory that stores a control program and so on executed by the CPU 11.

The RAM 13 is a memory that stores data to be temporarily stored and is used as a work memory of the CPU 11.

The external device I/O 14 is the interface to which various external devices will be connected for input/output from/to the external devices. An interface for connecting, for example, an external display, a mouse, a keyboard for inputting characters, a console panel and so on is prepared. Even when the display 15 and the controls 16 of the main body have quite simple configurations, these external devices may be used to set/change the parameters and instruct operations.

The display 15, which is a display unit that displays various kinds of information under control by the CPU 11, can be composed of, for example, a liquid crystal panel (LCD) or a light emitting diode (LED). In the example described herein, the digital mixer 10 includes, as the display 15, an LCD having a size capable of displaying a graphical user interface (GUI) for at least referring to values of parameters and accepting settings of the values.

The controls 16, which are devices for accepting an operation on the digital mixer 10, can be composed of various kinds of keys, buttons, rotary encoders, sliders and so on. A touch panel stacked on the LCD that is the display 15 is also used herein.

The waveform I/O 17 is the interface for accepting input of audio signal to be processed in the DSP 18 and outputting processed audio signals. A plurality of A/D conversion boards each capable of analog input of four channels, D/A conversion boards each capable of analog output of four channels, and digital input/output boards each capable of digital input/output of eight channels, can be installed in appropriate combination into the waveform I/O 17 which actually inputs/outputs signals through the boards.

The DSP 18 is a signal processor that includes a signal processing circuit and performs various kinds of signal processing such as mixing, equalizing and the like on audio signals inputted from the waveform I/O 17 in accordance with various processing parameters set as current data and outputs the processed audio signals to the waveform I/O 17. The current data including the parameters for the processing is stored in a current memory provided on the RAM 13 or on a memory included in the DSP 18 itself, and the user can confirm and change the value of the current data using the display 15 and the control 16.

Figure 2:
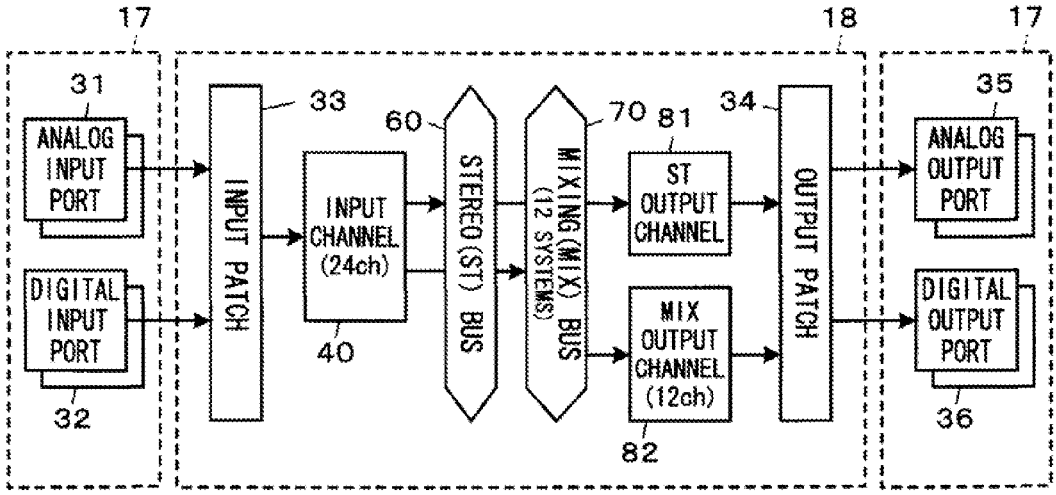
FIG. 2 is a diagram showing in more detail the configuration of signal processing executed in a DSP shown in FIG. 1.

Next, the configuration of the signal processing executed in the DSP 18 shown in FIG. 1 will be shown in more detail in FIG. 2.

The signal processing in the DSP 18 includes, as shown in FIG. 2, an input patch 33, input channels 40, stereo (ST) buses 60, mixing (MIX) buses 70, ST output channels 81, MIX output channels 82, and an output patch 34.

In the DSP 18, one of an analog input port 31 and a digital input port 32 which are prepared in the waveform I/O 17 in a manner to correspond to an input terminal is patched to each of 24 input channels 40. In each of the input channels, characteristics of the amplitude and the frequency of signals inputted through the patched port are adjusted by the attenuator, equalizer and the like, and the processed signals are then transmitted to the ST buses 60 and arbitrary buses of the MIX buses 70 of 12 systems.

In the ST buses 60 and the MIX buses 70, signals inputted from the input channels 40 are mixed, and the signals mixed in the ST buses 60 that are main buses are outputted to the ST output channel 81, whereas the signals mixed in the MIX buses 70 are outputted to the 12 MIX output channels 82 which are provided for the respective systems of the MIX buses. In each of the output channels 81 and 82, characteristics of the signals inputted through the corresponding bus are then adjusted by an equalizer, a compressor and the like, and the processed signals are patched to an analog output port 35 and a digital output port 36 which are prepared in the waveform I/O 17 in a manner to correspond to an output terminal by the output patch 34, and outputted through the output port to which the signals are patched.

Note that the substance of the signal processing by the modules provided in the DSP 18 can be controlled by setting the values of the parameters corresponding to the modules stored in the current memory. The functions of the modules may be realized by software or by hardware.

Figure 3:
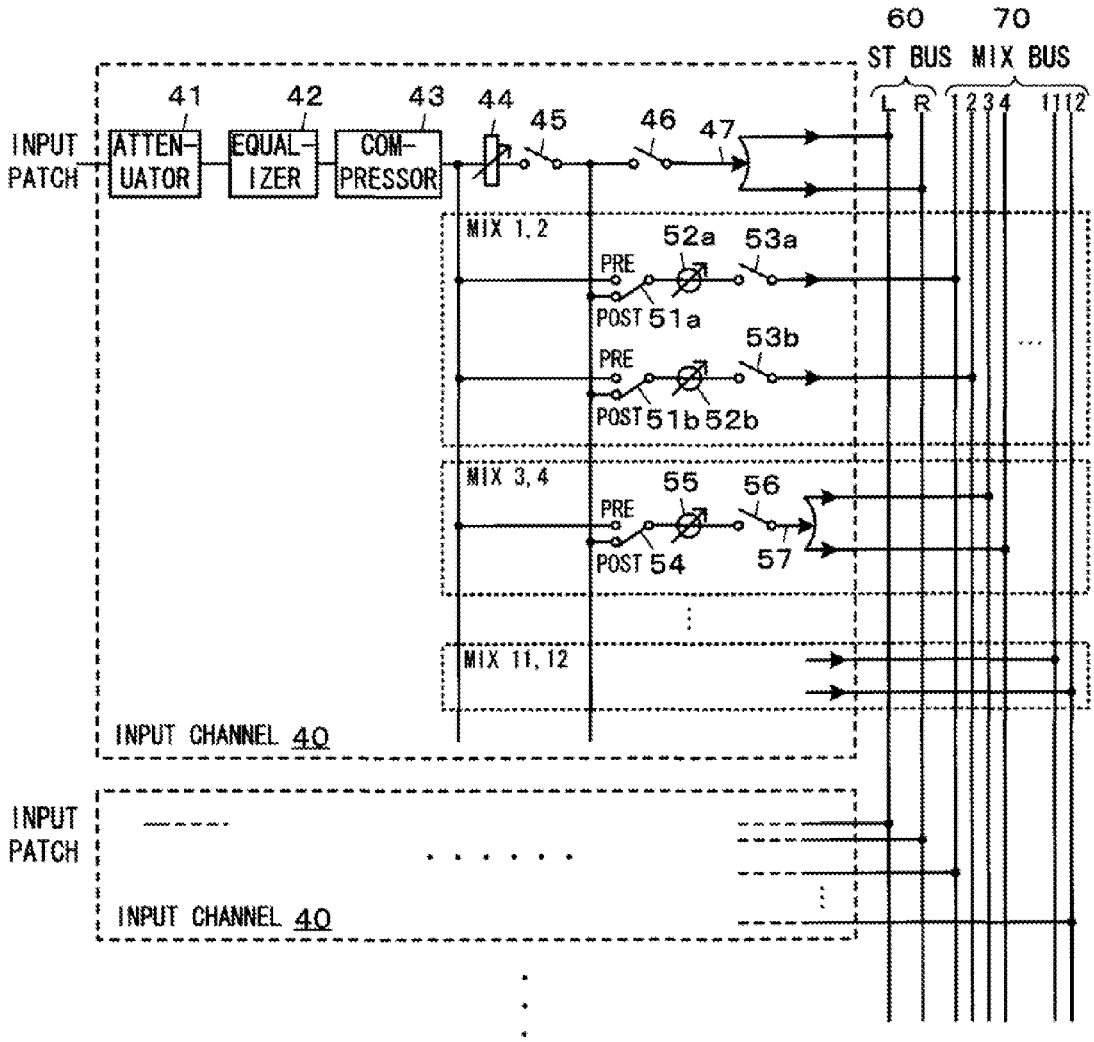
FIG. 3 is a diagram showing the configuration of a part relating to input of signals from each input channel to ST buses and MIX buses among the signal processing in the DSP shown in FIG. 1.

Next, the configuration of a part of the signal processing in the DSP 18 which relates to input of signals through each input channel to the ST buses and the MIX buses is shown in FIG. 3.

As shown in FIG. 3, an attenuator 41, an equalizer 42, a compressor 43, a channel fader 44, and an ON switch 45 are provided in each of the input channels 40. On the path provided ahead of them for inputting signals to the ST buses, a TO_ST (to stereo) switch 46 and a pan 47 are provided.

A signal inputted to such an input channel 40 is adjusted to a level suitable for the signal processing based on the attenuator parameters in the attenuator 41, adjusted in frequency characteristics based on the equalizer parameters in the equalizer 42, adjusted in amplitude based on dynamic amplitude characteristics based on the compressor parameter in the compressor 43, and adjusted to a level suitable for the mixing in the ST buses based on the fader parameters in the channel fader 44. The signal outputted from the channel fader 44 passes through the ON switch 45 and the TO_ST switch 46 when the ON parameters corresponding to the respective switches are ON, and is adjusted in level individually for L and for R based on the stereo pan parameter in the pan 47 and inputted into the ST buses 60 for L and for R.

On the path for inputting signals to each of the MIX buses 70, for each group composed of two buses, a transmission module according to the type of the buses is provided.

More specifically, a transmission module including PRE/POST switches 51*a* and 51*b*, send level faders 52*a* and 52*b*, and send ON switches 53*a* and 53*b* which correspond to the two buses respectively, is provided for the monaural type buses. In FIG. 3, the first and second MIX buses are the monaural type.

In the transmission module for the monaural type, a signal at a position (before the channel fader 44 for PRE or after the ON switch 45 for POST) according to the PRE parameters (PRE1, PRE2) in the input channel is selected by the PRE/POST switches 51*a*, 51*b* for each of the destination buses. The selected signal is adjusted to a level suitable for the mixing in the bus based on the send level parameter (SL1 or SL2) in the send level faders 52*a* or 52*b*, passes through the send ON switch 53*a* or 53*b* when the corresponding ON parameter (ON1 or ON2) is ON, and is inputted to the corresponding destination bus.

Besides, a transmission module including a PRE/POST switch 54, a send level fader 55, and a send ON switch 56, and a pan 57 which are common to the two buses, is provided for the stereo type buses. In FIG. 3, the third and fourth MIX buses are the stereo type.

In the transmission module for the stereo type, a signal at a position according to the PRE parameter (PRES) in the input channel is selected by the PRE/POST switch 54. The selected signal is adjusted in level based on the send level parameter (SLS) in the send level fader 55, passes through the send ON switch 56 when the corresponding ON parameter (ONS) is ON, is controlled in level individually for L and for R based on the pan parameter (PAN) in the pan 57 and inputted to the two destination buses in a group. Herein, among the two buses, the bus with a smaller number is used for L and the bus with a larger number is used for R.

Though only the configuration of one input channel 40 is shown in detail in HG 3, the remaining 23 input channels also have the same configuration. In the ST buses 60 and the MIX buses 70, the signals inputted from the 24 channels can be mixed.

The type of the buses in each group can be arbitrarily set by the user, and the CPU 11 that functions as a designating unit designates the type according to the settings.

Figure 4:
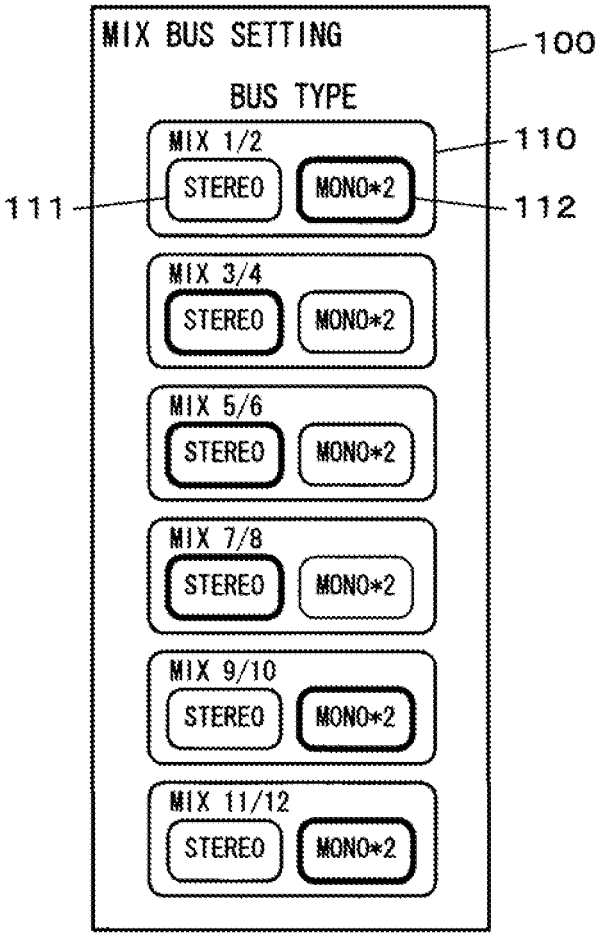
FIG. 4 is a view showing an example of a MIX bus setting screen displayed on the digital mixer shown in FIG. 1.

An example of a MIX bus setting screen for accepting the setting of the type of buses is shown in FIG. 4.

The MIX bus setting screen 100 shown in FIG. 4 is a GUI displayed, in response to the operation by the user, on the touch screen provided on the control panel of the digital mixer 10. The MIX bus setting screen 100 has a bus pair setting section 110 for displaying, for each group of the MIX buses, the type that is selected for the buses of a group and accepting operation of selecting the type.

A stereo button 111 and a monaural button 112 provided in the bus pair setting section 110 are used to display and accept the setting operation for stereo and monaural types.

Note that the type of the buses is selected "for the destination buses" but not for each input channel. When the type of some group of MIX buses is changed, the configuration of the signal transmission path to the MIX buses of that group will be changed in all of the input channels in response to the change.

When such a change in configuration has been made, predetermined initial values are set for the parameters corresponding to the changed portion. Specifically, the initial values of the PRE parameters (PRE1, PRE2, PRES) are "POST", the initial values of the send level parameters (SL1, SL2, SLS) are "−∞ dB (zero level)," the initial values of the ON parameters (ON1, ON2, ONS) are "ON," and the initial values of the pan parameter (PAN) is "±0 (center)." However, the values of the parameters before the change may be converted to the values of the parameters corresponding to the type after the change as in the case of a later-described preset recall.

Figure 5:
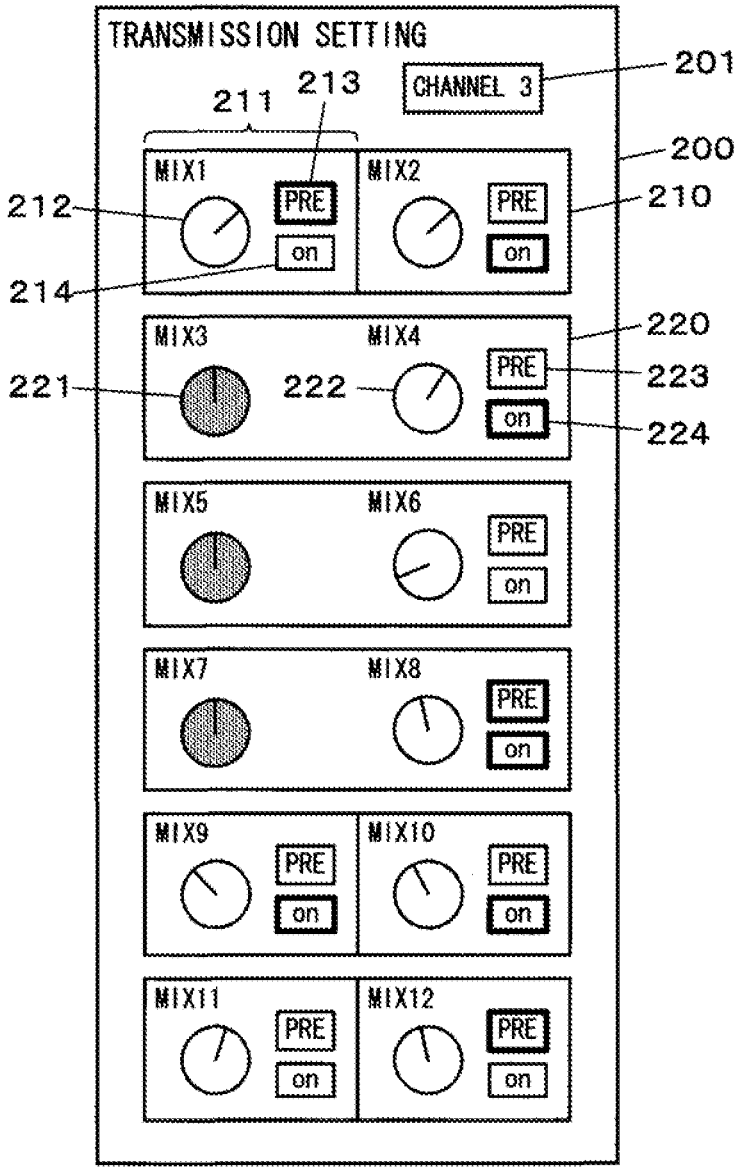
FIG. 5 is a view showing a transmission setting screen displayed on the digital mixer shown in FIG. 1.

Next, a display example of a transmission setting screen for accepting operation for setting parameters relating to the transmission of signals to the MIX buses among the parameters relating to the input channel is shown in FIG. 5.

The transmission setting screen 200 shown in FIG. 5 is also a GUI displayed, in response to the operation by the user, on the touch screen provided on the control panel of the digital mixer 10. The transmission setting screen 200 is a screen for displaying values of the parameters relating to transmission of signals from one input channel to the MIX buses of the 12 systems and accepting operation of editing the values of the parameters.

One input channel of interest is an arbitrary one that is selected in response to an operation by the user or automatically selected, and the name thereof is displayed on a channel display section 201.

In the transmission setting screen 200, bus pair setting sections 210 and 220 corresponding to respective groups of the MIX buses 70 are provided. The section depicted by a numeral 210 is the bus pair setting section for the monaural type group, and the section depicted by a numeral 220 is the bus pair setting section for the stereo type group. Both of the sections are areas for handling the parameters relating to transmission of signals to the buses of the corresponding group. The configurations of the bus pair setting sections 210 and 220 are different because the numbers and the kinds of parameters to be set are different between the stereo type and the monaural type as described above.

In the bus pair setting section 210 for the monaural type, monaural bus setting sections 211 corresponding to the two respective buses in a group are provided. In each of the monaural bus setting sections 211, display of values and acceptance of operation of editing the values for the send level parameters (SL1, SL2) of the send level faders 52*a* and 52*b*, the PRE parameters (PRE1, PRE2) of the PRE/POST switches 51*a* and 51*b*, and the ON parameters (ON1, ON2) of the send ON switches 53*a* and 53*b* on the transmission path to each of the buses can be performed via level knobs 212, PRE/POST buttons 213, and ON buttons 214.

In the bus pair setting section 220 for the stereo type which is a setting section common to the two buses in a group, display of values and acceptance of operation of editing the values for the pan parameter (PAN) of the pan 57, the send level parameter (SLS) of the send level fader 55, the PRE parameter (PRES) of the PRE/POST switch 54, and the ON parameter (ONS) of the send ON switch 56 on the transmission path to the two buses can be performed via a pan knob 221, a level knob 222, a PRE/POST button 223, and an ON button 224.

Next, the format of the parameters for the signal processing stored in the digital mixer 10 will be described.

In the digital mixer 10, the values of the parameters for the signal processing in the DSP 18 are stored in the current memory as described above. Hence, the configuration of data to be stored in the current memory is shown in FIG. 6.

Figure 6:
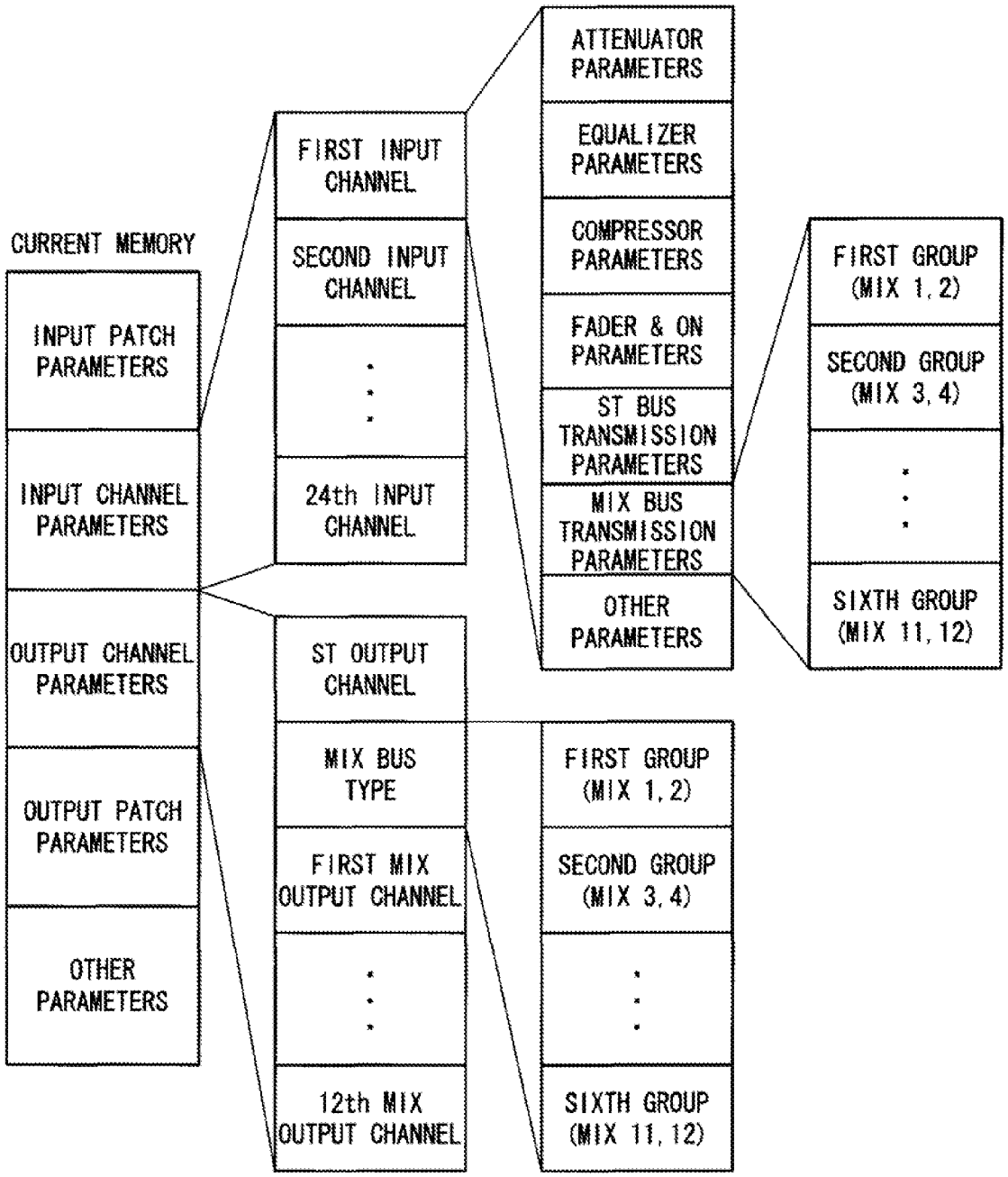
FIG. 6 is an illustration showing the configuration of data to be stored in a current memory of the digital mixer shown in FIG. 1.

As shown in FIG. 6, the data to be stored in the current memory, when broadly classified, includes input patch parameters that are parameters relating to operation of the input patch 33, input channel parameters that are parameters relating to operation of the input channels 40, output channel parameters that are parameters relating to operations of the ST output channels 81 and the MIX output channels 82, an output patch parameters that are parameters relating to operation of the output patch 34, and other parameters.

Among these parameters, a part of the input channel parameters and the output channel parameters are the portion relating to the characteristics of this embodiment and thus will be described in more detail.

As the input channel parameters, values of the parameters used in the signal processing elements shown in FIG. 3 are stored for each of the 24 input channels 40.

The parameters for each of the channels include the attenuator parameters used for processing in the attenuator 41, the equalizer parameters used for processing in the equalizer 42, the compressor parameters used for processing in the compressor 43, the fader parameter used for processing in the channel fader 44, and the ON parameter used for processing in the ON switch 45.

The transmission parameters to the ST buses (the ST bus transmission parameters) include the ON parameter for the TO_ST switch 46 and the pan parameter indicating the value of the sound image localization position of the pan 47.

The parameters for each of the input channels further include the MIX bus transmission parameters used for processing on the signal transmission paths to the MIX buses 70. Though the storage area for the transmission parameters for the MIX buses is prepared for each group of buses, the kinds of the parameters whose values are actually stored are different depending on the type of the MIX buses as described above as shown in Table 1.

TABLE 1

| Transmission parameters relating to MIX buses in one group |
|---|
| For monaural bus × 2 |
| switching of PRE/POST switch corresponding to each bus: PRE1, PRE2<br>gain of send level fader corresponding to each bus: SL1, SL2<br>ON/OFF of send ON switch corresponding to each bus: ON1, ON2 |
| For stereo buses × 1 |
| switching of PRE/POST switch: PRES<br>gain of send level fader: SLS<br>ON/OFF of send ON switch: ONS<br>sound image localization position by pan: PAN |

As the output channel parameters, values of the parameters used in the signal processing elements such as the compressor, the equalizer, the fader and the like included in the ST output channels 81 and each of the 12 MIX output channels 82 are stored. In addition, the MIX bus type that is information designating the type of the MIX buses in each group is also stored as a part of the output channel parameters.

In the digital mixer 10, a set of values of the parameters relating to one input channel of the input channels among the above substance in the current memory can be stored into a preset library as a preset. This store is executed in response to a store instruction by the user with designation of an input channel number and a destination preset number.

The stored preset can be recalled to the current memory as values of the parameters relating to an arbitrary input channel and reflected to the signal processing executed by the digital mixer 10. This recall is also executed in response to a recall instruction by the user with designation of a source preset number and a destination input channel number.

One of the characteristics of this embodiment is the operations for the store and recall of the preset. Hence, this point will be described below.

Figure 7:
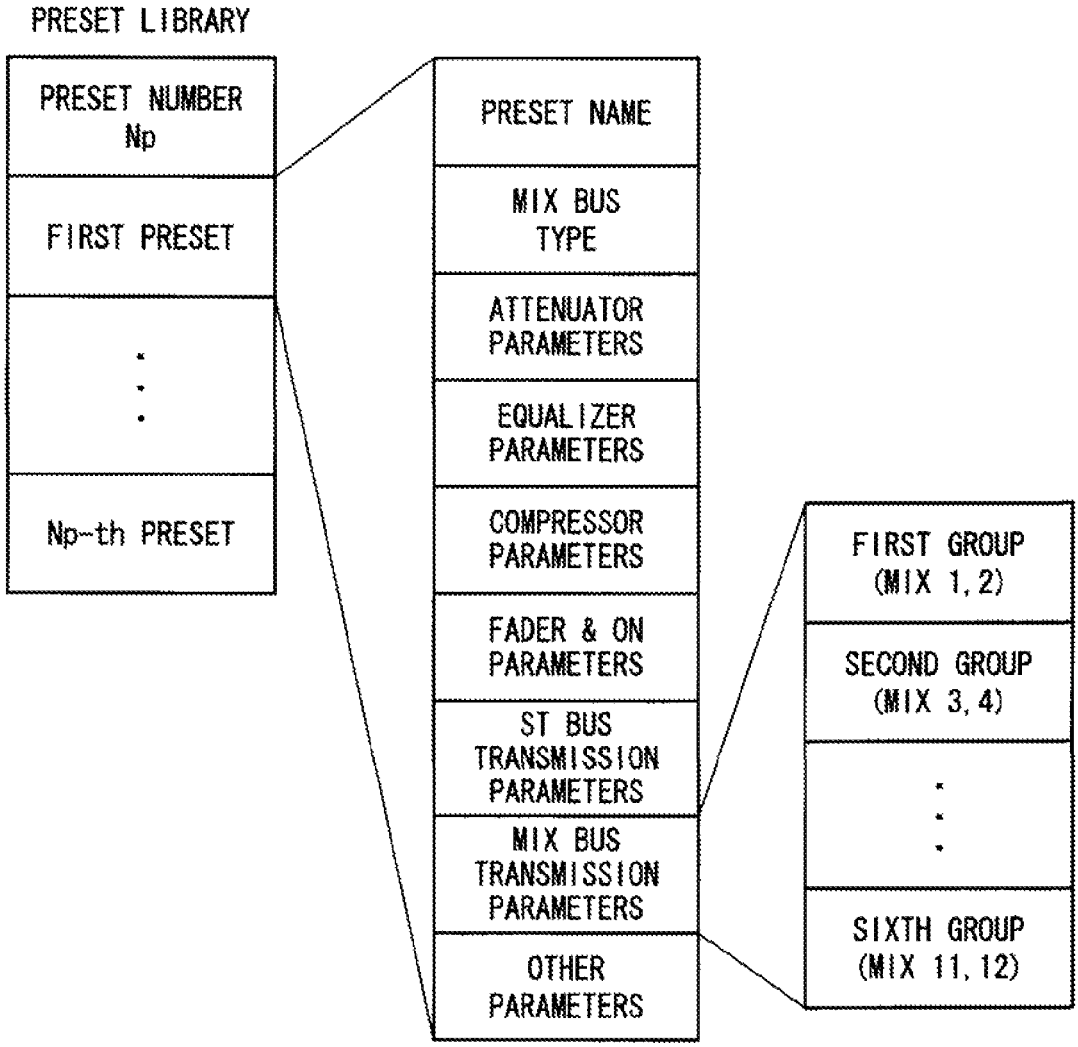
FIG. 7 is an illustration showing the configuration of data to be stored in a preset library of the digital mixer shown in FIG. 1.

First, the configuration of data to be stored in the preset library is shown in FIG. 7.

As shown in FIG. 7, a plurality of presets can be stored in the preset library, and areas where Np presets indicated by the number of presets Np are stored are provided in the digital mixer 10.

The data format of the attenuator parameters to the other parameters in each preset is completely same as that of the parameters relating to one input channel in the current memory shown in FIG. 6. Therefore, the data format of the MIX bus transmission parameters depends on the type of MIX buses in each group at the time of the store. Hence, information of the type of MIX buses is copied from the output channel parameters at the time of the store and registered in the preset so as to enable to easily grasp the data format.

In addition to the above, a preset name for easy identification of preset can also be registered.

Note that data to be copied to the current memory when recalling the above preset data are only the attenuator parameters to the other parameters that are the parameters relating to the input channel.

The preset library shown in FIG. 7 may be provided in the RAM 13 so that the data of the preset library are erased at power-off, or may be configured such that the data edited on the RAM 13 are stored in the flash memory 12 and held even after power-off.

Figure 8:
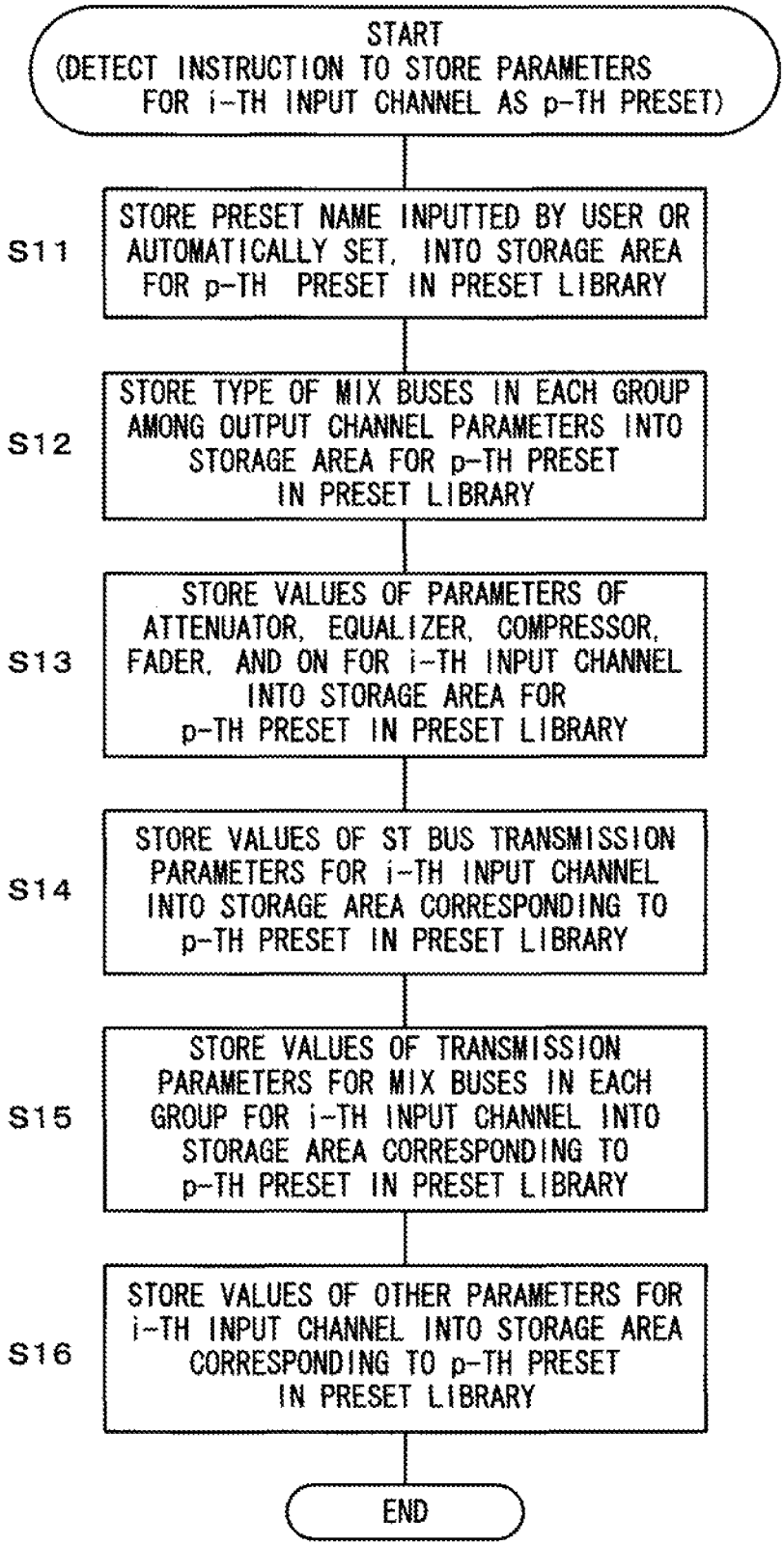
FIG. 8 is a flowchart of processing executed by a CPU of the digital mixer shown in FIG. 1 when an instruction to store the preset is detected.

Next, a flowchart of processing executed by the CPU 11 when an instruction to store a preset is detected is shown in FIG. 8.

Upon detection of the instruction to store parameters for the i-th input channel as the p-th preset by the user via a not-shown user interface, the CPU 11 of the digital mixer 10 starts the processing shown in the flowchart in FIG. 8.

The CPU 11 first stores the preset name that has been inputted by the user or automatically set, into the storage area for the p-th preset in the preset library (S11). The CPU 11 then stores the information of the type of MIX buses in each group among the output channel parameters stored in the current memory into the storage area for the p-th preset (S12).

Thereafter, the CPU 11 stores the values of the parameters for the i-th input channel stored in the current memory into the storage area corresponding to the p-th preset (S13 to S16), and ends the processing.

In the above processing, the CPU 11 functions as a storing device and stores the parameters of one input channel and the type of each MIX bus into the preset library as a preset shown in FIG. 7.

Figure 9:
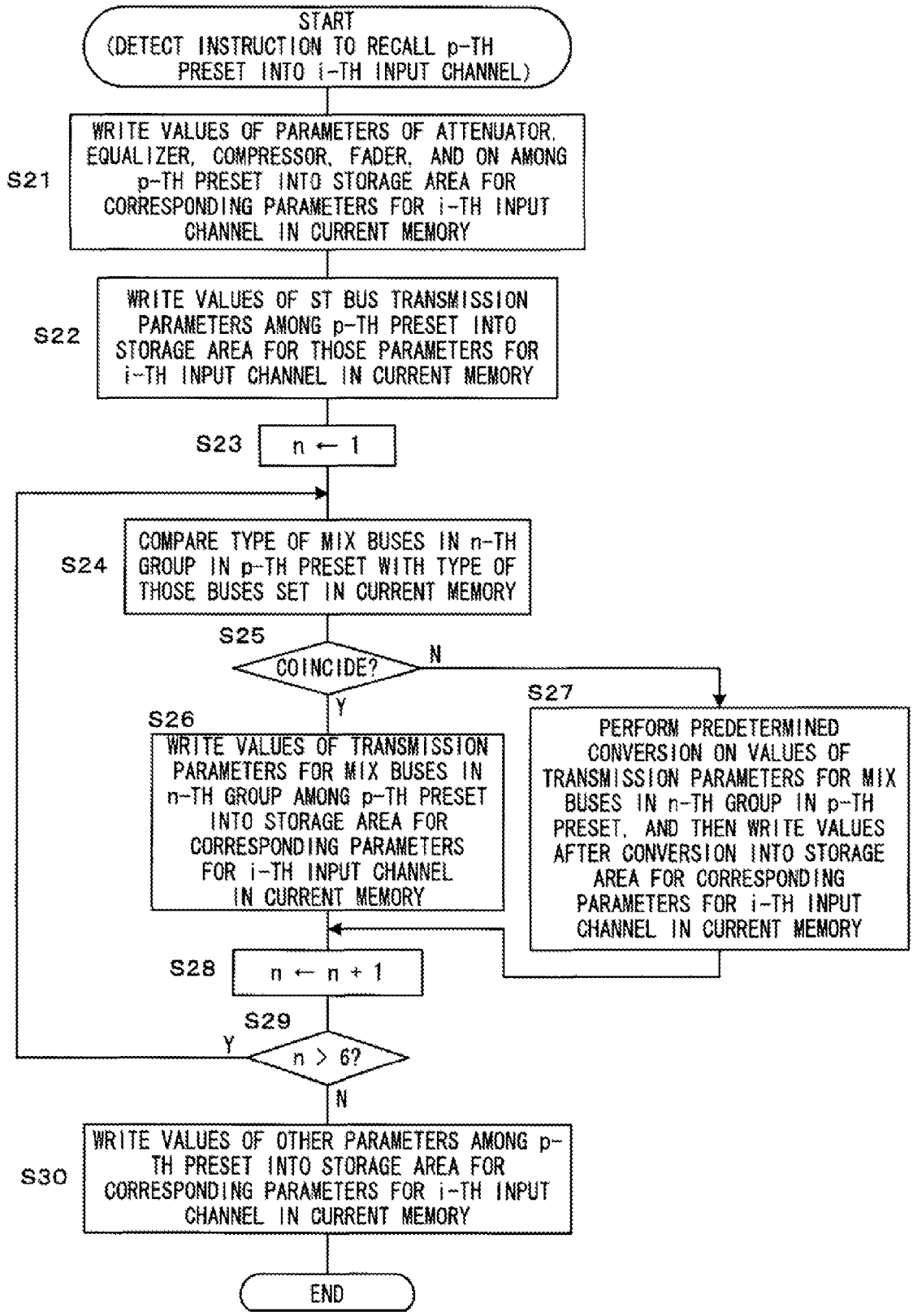
FIG. 9 is a flowchart of processing executed by the same CPU when an instruction to recall the preset is detected.

Next, a flowchart of processing executed by the CPU 11 when an instruction to recall the preset is detected is shown in FIG. 9.

Upon detection of the instruction to recall the p-th preset into the i-th input channel by the user via the not-shown user interface, the CPU 11 of the digital mixer 10 starts the processing shown in the flowchart in FIG. 9.

The CPU 11 first writes the values of the parameters of the portion having a common configuration irrespective of the type of the MIX buses, from the attenuator parameters to the ST bus transmission parameters among the p-th preset, into the storage area for corresponding parameters for the i-th input channel in the current memory (S21, S22).

Thereafter, the CPU 11 writes the values of the MIX bus transmission parameters by executing the processing from Step S24 to Step S27 while sequentially incrementing the variable n from 1 to 6 (S23, S28, and S29).

More specifically, the CPU 11 first compares the type of the MIX buses of the n-th group in the p-th preset concerning to the recall with the type of those buses set in the current memory (S24). When the types coincide with each other (S25), it is recognized that the format of the transmission parameters for the MIX buses in the n-th group in the p-th preset coincides with the format of those parameters in the current memory. The CPU 11 therefore just writes the values of the transmission parameters for the MIX buses in the n-th group in the p-th preset into the storage area for the corresponding parameters for the i-th input channel in the current memory (S26).

On the other hand, when the types do not coincide with each other at Step S25, the format of the transmission parameters for the MIX buses in the n-th group in the p-th preset is different from the format of those parameters in the current memory, so that the CPU 11 cannot write the values of the parameters appropriately as they are. Hence, the CPU 11 performs a later-described predetermined conversion on the values of the transmission parameters for the MIX buses in the n-th group in the p-th preset to thereby convert the values in the preset into values of the parameters in the format corresponding to the bus type in the current memory, and then writes the values after the conversion into the storage area of the corresponding parameters for the i-th input channel in the current memory (S27).

After completion of the processing for all of the groups of n=1 to 6, the CPU 11 writes the values of the other parameters similarly to at Steps S21 and S22 (S30), and ends the processing.

In the above processing, the CPU 11 functions as a recalling device and recalls the data of the preset stored in the preset library as the values of the parameters for one arbitrary input channel. In this case, even when the type of MIX buses at the time of the recall is different from the type at the time of the store of the preset, the user does not have to pay attention at all to the difference in the type because the format of the parameters are automatically converted.

Next, methods of converting the formats of the parameters will be described.

By the conversion methods, values of the parameters corresponding to the type of the buses selected at the time of the recall can be obtained based on the values of the parameters in a preset so that signals as close as possible to the signals which have been supplied to the MIX buses under the conditions at the time of the store including the type can be supplied to the MIX buses even when the signal transmission paths according to the type set at the time of the recall is used.

Concrete steps of the processing differ depending on the conversion direction, that is, whether converting the parameters for the monaural type at the time of the store into parameters for the stereo type or converting the parameters for the stereo type at the time of the store into parameters for the monaural type, as shown below in Table 2. In this table, parameters required in the format after the conversion are shown in the left column and methods of calculating the values are shown in the right column for each conversion direction (see Table 1 shown above for the names of the parameters).

TABLE 2

| Conversion methods of transmission parameters | |
|---|---|
| Stereo buses × 1 → Monaural bus × 2 | |
| SL1 | adjust value of SLS by adjustment value obtained by applying value of PAN to conversion table (see FIG. 10) (SLS + ΔL1(PAN)) |
| SL2 | adjust value of SLS by adjustment value obtained by applying value of PAN to conversion table (see FIG. 10) (SLS + ΔL2(PAN)) |
| ON1, 2 | adopt value of ONS |
| PRE1, 2 | adopt value of PRES |
| Monaural bus × 2 → Stereo buses × 1 | |
| PAN | apply value of SL1-SL2 to conversion table (see FIG. 11) |
| SLS | adjust value of SL1 or SL2 by adjustment value obtained by applying value of PAN to conversion table (see FIG. 10) (SL1 − ΔL1(PAN) or SL2 − ΔL2(PAN)) |
| ONS | ON when both of ON1 and ON2 are ON, otherwise OFF |
| PRES | PRE when both of PRE1 and PRE2 are PRE, otherwise POST |

The methods of calculating the values of the parameters will be described below more concretely.

First, for converting the parameters for the stereo type into the parameters for the monaural type, the gains of the send level faders 52*a* and 52*b* are adjusted so that the signal which has been adjusted in level by the send level fader 55 and distributed by the pan 57 is supplied to each bus. To this end, the gain of the send level fader 55 for the stereo type is adjusted by the adjustment values indicating the distribution ratio between the right and left buses by the pan 57 to obtain the send level parameters of the send level faders corresponding to the bus on the L side and the bus on the R side.

Various methods are applicable as the method of determining the adjustment values used here. As disclosed, for example, in JP 3266045 B, assuming that a positional constant of the sound image localization position is x (where L 100% when x=0, middle when x=n/2, R 100% when x=π), the adjustment value ΔL1 on the L side and the adjustment value ΔL2 on the R side can be obtained by the following Expressions 1 and 2, respectively.

$$\Delta L1=\cos(x/2) \quad \text{(Expression 1)}$$

$$\Delta L2=\sin(x/2) \quad \text{(Expression 2)}$$

Note that the adjustment values obtained by the above expressions are the adjustment values in linear representation which indicate the ratio between the level of the signal after gain adjustment by the send level fader 55 and the level of the signals after gain adjustment by the send level faders 52*a* and 52*b*.

Figure 10:
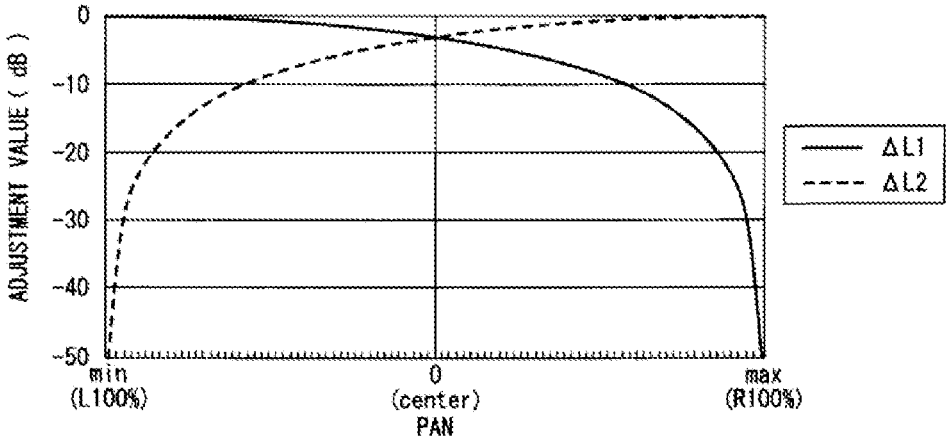
FIG. 10 is a graph depicting the relations between decibel-converted adjustment values and values of the pan parameter, used for the conversion of the parameter.

Hence, a graph depicting the relations between the decibel-converted adjustment values ΔL1 and ΔL2 and the values of the pan parameter is shown in FIG. 10. In consideration of the settable range of the parameter, the minimum value of the adjustment value is set at −50 decibels. Actually, it is only necessary to store the values of the adjustment values ΔL1 (PAN) and ΔL2 (PAN) corresponding to the values of the pan parameter in the conversion table.

In the case where the values of the parameters are represented in decibel, the values of the send level parameters which should be set for the send level faders 52*a* and 52*b* respectively can be obtained by adding (corresponding to multiplication in the linear representation) the adjustment values to the send level parameter SLS of the fader 55 as shown in Table 1.

Besides, the states of the PRE/POST switch 54 and the ON switch 56 for the stereo type may be just adopted as the states of the PRE/POST switches 51*a* and 51*b* and the states of the ON switches 52*a* and 52*b*.

Conversely, when the parameters for the monaural type are converted to the parameters for the stereo type, the gain of the send level fader 55 and the sound image localization position of the pan 57 are also determined so that the signals after distribution by the pan 57 coincide as much as possible with the signals which have been supplied to the buses in the monaural state. In short, conversion converse to the above-described conversion SLS to SL1, SL2 is performed.

Here, since $$\tan(x/2)=\Delta L2/\Delta L1$$

is obtained from the above-described Expressions 1 and 2, $$x=2\times\tan^{-1}(\Delta L2/\Delta L1) \quad \text{(Expression 3).}$$

ΔL2/ΔL1 represents the volume ratio between L and R when the signal in one system is distributed to the bus for L and the bus for R, and therefore it is found that the sound image localization position can be obtained based on the volume ratio between L and R from the Expression 3.

Figure 11:
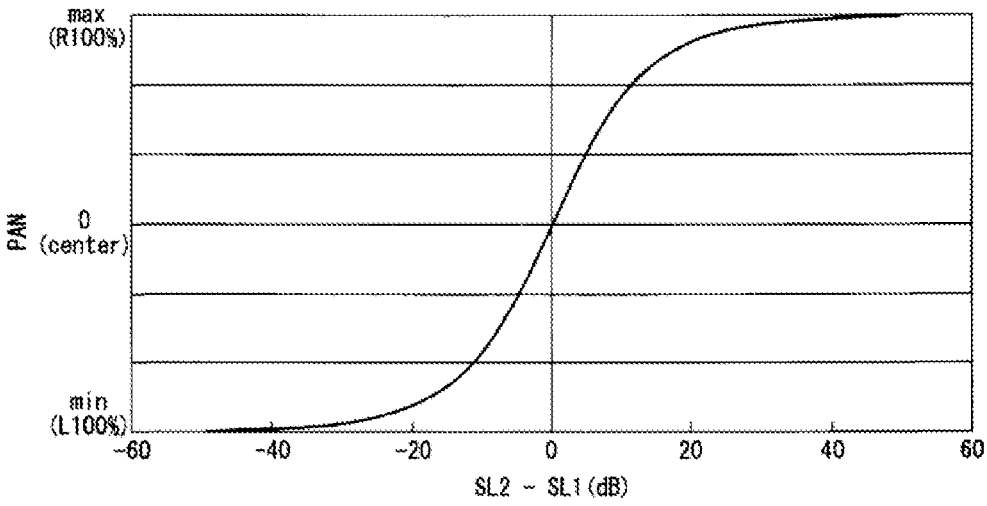
FIG. 11 is a graph depicting the relation between the ratio between send levels corresponding to two respective buses and values of the pan parameter, used for the conversion of parameter.

A graph of the relation between the ratio between send levels corresponding to the two respective buses and the value of the pan parameter (PAN) calculated based on the Expression 3 is shown in FIG. 11. Incidentally, the actual values of the send level parameters (SL1, SL2) are represented in decibel, and therefore the horizontal axis is not in linear scale but in decibel scale. The ratio between the send levels in this case is the difference between SL2 and SL1.

Actually, it is possible to store the values of the parameter of the pan corresponding to classes of the difference between the values of the send level parameters in the conversion table, and to obtain the value of the parameter PAN of the pan by searching this table based on the value of SL2−SL1.

Also in the case of this conversion, the relations $$SL1=SLS+\Delta L1(\text{PAN}) \text{ and}$$

$$SL2=SLS+\Delta L2(\text{PAN})$$

are also established as in the case of conversion from the stereo type to the monaural type. Accordingly, when the value of PAN is determined, the value of the send level for the stereo type can be obtained based on the value of the send level for one of the buses in the monaural type and on the value of the pan parameter obtained above, using $$SLS=SL1-\Delta L1(\text{PAN}) \text{ or}$$

$$SLS=SL2-\Delta L2(\text{PAN}).$$

Herein, it is preferable to use one of the two Expressions in which the larger one of SL1 and SL2 is referred. This makes it possible to reduce the error in the obtained value of the send level parameter (SLS) in the decibel representation.

Further, when the states of the PRE/POST switches 51*a* and 51*b* corresponding to the two buses in the monaural type coincide with each other, the state may be just adopted as the state of the PRE/POST switch 54. When the states of the ON switches 52*a* and 52*b* corresponding to the two buses for the monaural type coincide with each other, the states may be just adopted as the state of the ON switch 56.

Conversely, when the aforementioned states are different between the two buses in the monaural type, setting to supply the signals identical to those indicated by the parameters for the monaural type to the buses using the transmission path in the stereo type cannot be made. However, the PRE/POST switch 54 is set to PRE when the PRE/POST switches on both of two transmission paths in the monaural type are PRE and otherwise set to POST, and the ON switch 56 is set to ON when the ON switches on both of two transmission paths in the monaural type are ON and otherwise set to OFF here so that unintended high level signals are not outputted in the conditions set according to the preset.

In the digital mixer 10, by performing the above-described conversion processing at Step S27 in FIG. 9, the preset can be recalled in the form available under the conditions at the time of the recall while maximally making use of the preset even when the type of the buses at the time of the recall is different from the type at the time of the store.

At the end of the description of the above embodiment, the configuration of the apparatus, the concrete processing steps, the format or contents of the screens, the operation method, the configuration and conversion methods of the parameters, and so on are not, of course, limited to those described in the above embodiment.

For example, though the example in which the send level parameter for the send level fader is in decibel representation has been described in the above-described embodiment, there is, naturally, no problem even when the send level parameter is in the linear representation.

Figure 12:
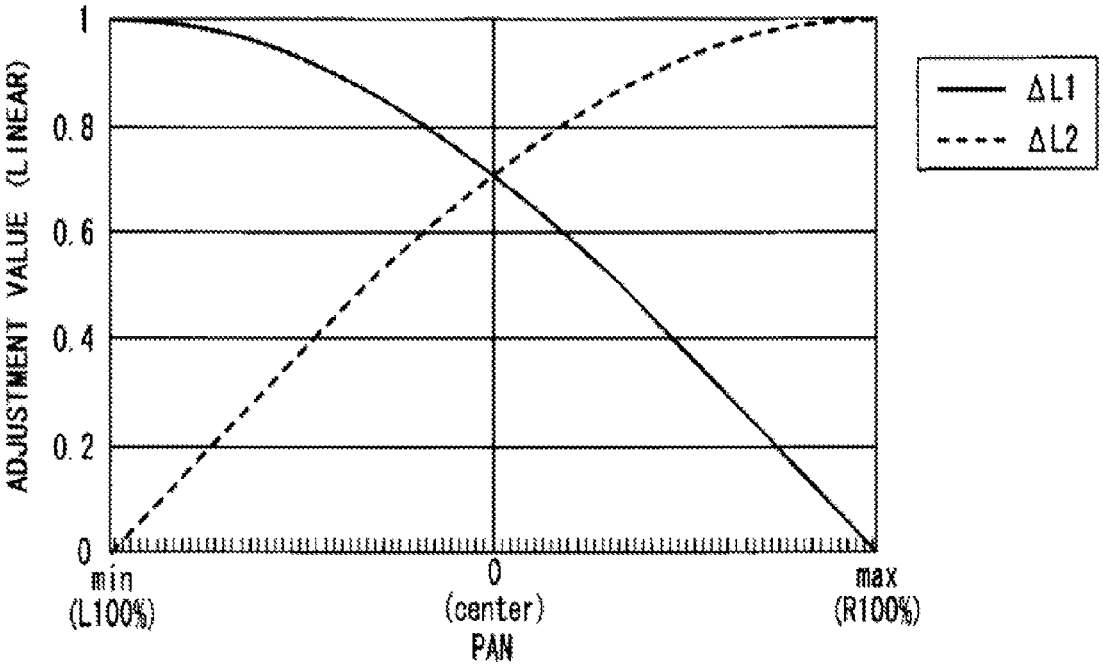
FIG. 12 is a graph depicting the relation between adjustment values in linear representation and values of the pan parameter, corresponding to FIG. 10.

In this case, as shown in FIG. 12, it is conceivable that the linear values are prepared also for ΔL1 and ΔL2 corresponding to the values of PAN, so that the values of the send level parameters to be respectively applied for the send level faders 52*a* and 52*b* can be obtained by multiplying the value of the send level parameter SLS for the fader 55 by the respective adjustment values, as expressed by $$SL1=SLS\times\times L1(\text{PAN})\text{ and}$$

$$SL2=SLS\times\Delta L2(\text{PAN}).$$

Though illustration of a graph corresponding to that in FIG. 11 is omitted, a similar conversion table with the horizontal axis of SL2/SL1 can be created and used.

Besides, as the states of the PRE/POST switch 54 and the ON switch 56 in the case where the parameters for the monaural type are converted to the parameters for the stereo type, it is also conceivable that the setting relating to any one of the two buses of the monaural type, for example, the bus with a smaller bus number is just handed over other than the conversion method shown in Table 2.

Though the example in which there are MIX buses 70 for 6 groups composed of 12 systems has been described in the above embodiment, the invention is applicable to the digital mixer 10 including minimally MIX buses for one group composed of two systems. Further, it is also conceivable that the processing of parameter conversion as in FIG. 9 is applied only to a part of buses, and the following handling is performed for the other buses: in the case where the type of the buses at the time of the recall of the preset is different from the type at the time of the store, such a recall is regarded as an error and the recall is stopped, or the parameters regarding a part of the buses whose type at the time of the recall is different from the type at the time of the store is not recalled among the recalled preset.

The digital mixer 10 can also be realized not only by the dedicated hardware but also as the function of a DAW (Digital Audio Workstation) application running on a PC.

The above-described configurations and modifications can be applied in appropriate combination as long as they do not contradict each other.

As is obvious from the above description, according to the digital mixer of the invention, it is possible, in the case where a monaural or stereo type can be selected for a pair of mixing buses and in the case where parameters for one input channel can be stored and recalled, the values of parameters relating to signal transmission from the input channel to the mixing buses can be appropriately recalled even when the type of the buses at the time of recalling the parameters is different from the type of the buses at the time of storing the parameters.

Accordingly, application of the invention can improve the operability of the digital mixer.

What is claimed is:

1. A digital mixer comprising:

two mixing buses that respectively mix audio signals supplied from a plurality of input channels;

a designating device that designates either of monaural or stereo as a bus type of said two mixing buses;

a current memory that stores values of parameters corresponding to the bus type designated by the designating device, for each of said plurality of input channels;

an editor that edits the value of the parameter stored in said current memory in response to an edit operation by a user;

a plurality of level controllers, each of which is in each input channel of said plurality of input channels, and controls level of an audio signal inputted to the input channel based on the bus type designated by the designating device and the values of the parameters stored in the current memory for the input channel, and the audio signal after the control being supplied from the input channel to said two mixing buses;

a library that stores a plurality of presets;

a storing device that stores, in response to a store operation regarding one input channel and one preset by the user, the values of the parameters stored in the current memory for the one input channel and the bus type currently designated by the designating device, as the one preset into said library; and a recalling device that, in response to a recall operation regarding one input channel and one preset by the user, reads values of the parameters and the bus type of the one preset stored in the library, and a) if the bus type in the one preset coincides with the bus type designated by the designating device, writes the values of the parameters of the one preset into said current memory as the values of the parameters for the one input channel, and b) if the bus type of the one preset does not coincide with the bus type designated by the designating device, converts the values of the parameters of the one preset into values of the parameters corresponding to the bus type designated by the designating device and writes into said current memory as the values of the parameters for the one input channel.

2. The digital mixer according to claim 1, wherein said current memory stores, for each of said plurality of input channels, a) values of two level parameters corresponding to each of said two mixing buses, if said designating device designates monaural as the bus type, and b) values of one level parameter and one pan parameter corresponding to a pair of said two mixing buses, if said designating device designates stereo as the bus type.

3. The digital mixer according to claim 2, wherein if the bus type in the one preset to be recalled is stereo and the bus type designated by the designating device is monaural, said recalling device converts the values of said one level parameter and said one pan parameter of the one preset read out from the library into the two level parameters corresponding to each of said two mixing buses, such that an adjustment value for L and an adjustment value for R are obtained based on the value of the one pan parameter of the one preset, and then are respectively added to the one level parameter of the one preset or respectively multiply the one level parameter of the one preset to obtain the two level parameters.

4. The digital mixer according to claim 2, wherein if the bus type in the one preset to be recalled is monaural and the bus type designated by the designating device is stereo, said recalling device converts the values of the two level parameters of the one preset read out from the library into the values of said one level parameter and said one pan parameter corresponding to said pair of the buses such that the value of the one pan parameter is obtained based on a difference or a ratio between the values of the two level parameters, and the value of the one level parameter is obtained based on the value of one of the two level parameters and the obtained value of the pan parameter.

5. A digital mixer comprising:

a pair of mixing buses having a plurality of input channels, wherein the pair of mixing buses respectively mix audio signals supplied from the plurality of input channels, and the pair mixing buses are designatable as a monaural or stereo bus type;

a memory adapted to store values of parameters for each of the plurality of input channels;

a storing device that stores, in response to a store operation regarding one of the plurality of input channels, the values of the parameters stored in the memory for the one input channel and the designated bus type, as one preset; and a recalling device that, in response to a recall operation regarding the one input channel, reads the values of the parameters and the bus type in the one preset stored in the storing device, wherein the recalling device, if the bus type in the one preset coincides with the currently designated bus type, writes the values of the parameters of the one preset stored in the storing device into the memory as the values of the parameters for the one input channel, and wherein the recalling device, if the bus type in the one preset does not coincide with the currently designated bus type, converts the values of the parameters of the one preset into the values of the parameters corresponding to the currently designated bus type and writes into the memory as the values of the parameters for the one input channel.

6. The digital mixer according to claim 5, wherein the memory stores, for each of the plurality of input channels, (a) values of two level parameters corresponding to each of the pair of mixing buses, if the monaural bus type is designated, and (b) values of one level parameter and one pan parameter corresponding to the pair mixing buses, if the stereo bus type is designated.

7. The digital mixer according to claim 6, wherein the recalling device, if the one preset to be recalled is the stereo bus type while the currently designated bus type is monaural, converts the values of the one level parameter and the one pan parameter of the one preset read out from the storing device into the two level parameters corresponding to each of the pair of mixing buses, so that an adjustment value for L and an adjustment value for R are obtained based on the value of one pan parameter of the one preset, and then are respectively added to the one level parameter of the one preset or respectively multiply the one level parameter of the one preset to obtain the two level parameters.

8. The digital mixer according to claim 6, wherein the recalling device, if the bus type in the one preset to be recalled is the monaural bus type while the currently designated bus type is stereo, converts the values of the two level parameters of the one preset read out from the storing device into the values of the one level parameter and one pan parameter so that the value of the one pan parameter is obtained based on a difference or a ratio between the values of the two level parameters, and the value of the one level parameter is obtained based on the value of one of the two level parameters and the obtained value of the pan parameter.

9. A method of controlling a digital mixer comprising a pair of mixing buses having a pair of mixing buses having a plurality of input channels, wherein the pair of mixing buses respectively mix audio signals supplied from the plurality of input channels, and the pair mixing buses are designatable as a monaural or stereo bus type; a memory; and a storing device, the method comprising:

a first storing step of storing, in the memory, values of parameters for each of the plurality of input channels;

a second storing step of storing, in the storing device, in response to a store operation regarding one of the plurality of input channels, the values of the parameters stored in the memory for the one input channel and the designated bus type, as one preset;

a reading step of reading in response to a recall operation regarding the one input channel, the values of the parameters and the bus type in the one preset stored in the storing device;

a first writing step of writing, if the bus type in the one preset coincides with the currently designated bus type, the values of the parameters of the one preset stored in the storing device into the memory as the values of the parameters for the one input channel; and a second writing step of converting, if the bus type in the one preset does not coincide with the currently designated bus type, the values of the parameters of the one preset into the values of the parameters corresponding to the currently designated bus type, and writing into the memory as the values of the parameters for the one input channel.

10. The method according to claim 9, wherein the first storing step stores, in the memory, for each of the plurality of input channels, (a) values of two level parameters corresponding to each of the pair of mixing buses, if the monaural bus type is designated, and (b) values of one level parameter and one pan parameter corresponding to the pair mixing buses, if the stereo bus type is designated.

11. The method according to claim 10, wherein the second writing step converts, if the one preset to be recalled is the stereo bus type while the currently designated bus type is monaural, the values of the one level parameter and the one pan parameter of the one preset read out from the storing device into the two level parameters corresponding to each of the pair of mixing buses, so that an adjustment value for L and an adjustment value for R are obtained based on the value of one pan parameter of the one preset, and then are respectively added to the one level parameter of the one preset or respectively multiply the one level parameter of the one preset to obtain the two level parameters.

12. The method according to claim 10, wherein the second writing step converts, if the bus type in the one preset to be recalled is the monaural bus type while the currently designated bus type is stereo, the values of the two level parameters of the one preset read out from the storing device into the values of the one level parameter and one pan parameter so that the value of the one pan parameter is obtained based on a difference or a ratio between the values of the two level parameters, and the value of the one level parameter is obtained based on the value of one of the two level parameters and the obtained value of the pan parameter.

* * * * *